US006592333B1

(12) United States Patent
Magallanes

(10) Patent No.: US 6,592,333 B1
(45) Date of Patent: Jul. 15, 2003

(54) UNIVERSAL CONDENSATE PUMP KIT

(76) Inventor: James A. Magallanes, 11704 Gray Way, Westminster, CO (US) 80020

( * ) Notice: Subject to any disclaimer, the term of this patent is extended or adjusted under 35 U.S.C. 154(b) by 0 days.

(21) Appl. No.: 10/091,690

(22) Filed: Mar. 5, 2002

Related U.S. Application Data

(63) Continuation-in-part of application No. 10/046,016, filed on Jan. 10, 2002, now abandoned.

(51) Int. Cl.[7] ..... F04B 49/00

(52) U.S. Cl. ..... 417/36; 417/423.7; 62/280; 62/272; 62/150; 310/179; 310/180; 310/71

(58) Field of Search ..... 417/36, 40, 423.1, 417/423.7; 62/280, 272, 150; 310/179, 180, 71

(56) References Cited

U.S. PATENT DOCUMENTS 3,758,236 A 9/1973 Zimmerman ..... 417/360
5,170,017 A * 12/1992 Stanevich et al. ..... 174/153 G
5,241,843 A * 9/1993 Hein ..... 68/3 R
5,260,678 A * 11/1993 Van Wagener et al. ..... 336/96
5,293,894 A * 3/1994 Fleischmann ..... 137/135
5,501,605 A * 3/1996 Ozaki et al. ..... 439/34
6,120,327 A * 9/2000 O'Brien et al. ..... 439/623
6,218,740 B1 * 4/2001 Mildice ..... 307/10.1
6,220,874 B1 * 4/2001 Kurata et al. ..... 439/76.2
6,291,770 B1 * 9/2001 Casperson ..... 174/72 A
6,322,326 B1 11/2001 Davis et al. ..... 417/40
6,422,839 B1 * 7/2002 Brockner et al. ..... 417/423.7
6,429,544 B1 * 8/2002 Sasaki et al. ..... 307/10.1
6,439,923 B1 * 8/2002 Kirkendall et al. ..... 439/502

* cited by examiner

*Primary Examiner*—Charles G. Freay
*Assistant Examiner*—William H. Rodriguez
(74) *Attorney, Agent, or Firm*—Donald J. Ersler

(57) ABSTRACT

A universal condensate pump kit includes a universal condensate pump and an adapting wire harness. The universal condensate pump includes a condensate pump, at least one drain switch unit, an overflow switch unit, and a condensate tank. Condensate liquid enters an inlet of the condensate pump which is then pumped out of a device such as an air conditioner or heat pump. The adapting wire harness is used to electrically connect the universal condensate pump with the device. If actuated, the at least one drain switch turns on the condensate pump. If actuated, the overflow switch will open or close a circuit that turns off power to the device and/or closes an alarm circuit on the device. At least one connector provides electrical connection to the condensate pump, drain switch, and overflow switch. The adapting wire harness includes at least one pump connector which terminates one end of the plurality of wires and a plurality of device connectors which terminate the other end thereof. Different adapting wire harnesses exist for different makes and models of devices.

21 Claims, 15 Drawing Sheets

| PUMP CONNECTOR | | | | WIRE | | | PUMP LOCATION |
|---|---|---|---|---|---|---|---|
| NO. | PART NO. | TERM. P/N | PIN NO. | COLOR | GUAGE | STYLE | |
| 31 | MOLEX P/N 43020-0401 | MOLEX P/N 43031-0007 | 1A | GREEN | 20 | 1569 | 42 |
| | | | 2A | WHITE | 20 | 1569 | 30 |
| | | | 3A | BLACK | 20 | 1569 | 44 |
| | | | ~~4A~~ | | | | |
| 33 | MOLEX P/N 43020-0401 | MOLEX P/N 43031-0007 | 1B | YELLOW | 20 | 1569 | 36 |
| | | | 2B | BLUE | 20 | 1569 | 38 |
| | | | 3B | ORANGE | 20 | 1569 | 40 |
| | | | 4B | PURPLE | 20 | 1569 | 28 |
| 35 | MOLEX P/N 43020-0201 | MOLEX P/N 43031-0007 | 1C | RED | 20 | 1569 | 46 |
| | | | 2C | ORANGE | 20 | 1569 | 41 |

FIG. 4

| PUMP CONNECTOR | | | | WIRE | | | PUMP LOCATION |
|---|---|---|---|---|---|---|---|
| NO. | PART NO. | TERM. P/N | PIN NO. | COLOR | GUAGE | STYLE | |
| 31 | MOLEX P/N 43020-0401 | MOLEX P/N 43031-0007 | 1A | GREEN | 20 | 1569 | 42 |
| | | | 2A | WHITE | 20 | 1569 | 30 |
| | | | 3A | BLACK | 20 | 1569 | 44 |
| | | | ~~4A~~ | | | | |
| 33 | MOLEX P/N 43020-0401 | MOLEX P/N 43031-0007 | 1B | YELLOW | 20 | 1569 | 36 |
| | | | 2B | BLUE | 20 | 1569 | 38 |
| | | | 3B | ORANGE | 20 | 1569 | 40 |
| | | | 4B | PURPLE | 20 | 1569 | 28 |
| 35 | MOLEX P/N 43020-0201 | MOLEX P/N 43031-0007 | 1C | RED | 20 | 1569 | 46 |
| | | | 2C | ORANGE | 20 | 1569 | 41 |
| 39 | MOLEX P/N 43020-0201 | MOLEX P/N 43031-0007 | 1D | BROWN | 20 | 1569 | 32 |
| | | | 2D | BLUE | 20 | 1569 | 36 |

FIG. 4a

| PUMP CONNECTOR | | | | WIRE | | | PUMP LOCATION |
|---|---|---|---|---|---|---|---|
| NO. | PART NO. | TERM. P/N | PIN NO. | COLOR | GUAGE | STYLE | |
| 37 | MOLEX P/N 43020-0401 | MOLEX P/N 43031-0007 | 1A | GREEN | 20 | 1569 | 42 |
| | | | 2A | WHITE | 20 | 1569 | 30 |
| | | | 3A | BLACK | 20 | 1569 | 47 |
| | | | 4A | RED | 20 | 1569 | 49 |
| 33 | MOLEX P/N 43020-0401 | MOLEX P/N 43031-0007 | 1B | YELLOW | 20 | 1569 | 36 |
| | | | 2B | BLUE | 20 | 1569 | 38 |
| | | | 3B | ORANGE | 20 | 1569 | 40 |
| | | | 4B | PURPLE | 20 | 1569 | 28 |

FIG. 7

| PUMP CONNECTOR | | | | WIRE | | | PUMP LOCATION |
|---|---|---|---|---|---|---|---|
| NO. | PART NO. | TERM. P/N | PIN NO. | COLOR | GUAGE | STYLE | |
| 37 | MOLEX P/N 43020-0401 | MOLEX P/N 43031-0007 | 1A | GREEN | 20 | 1569 | 42 |
| | | | 2A | WHITE | 20 | 1569 | 30 |
| | | | 3A | BLACK | 20 | 1569 | 47 |
| | | | 4A | RED | 20 | 1569 | 49 |
| 33 | MOLEX P/N 43020-0401 | MOLEX P/N 43031-0007 | 1B | YELLOW | 20 | 1569 | 36 |
| | | | 2B | BLUE | 20 | 1569 | 38 |
| | | | 3B | ORANGE | 20 | 1569 | 40 |
| | | | 4B | PURPLE | 20 | 1569 | 28 |
| 39 | MOLEX P/N 43020-0201 | MOLEX P/N 43031-0007 | 1D | BROWN | 20 | 1569 | 32 |
| | | | 2D | BLUE | 20 | 1569 | 36 |

FIG. 7a

| PUMP CONNECTOR | | | | WIRE | | | DEVICE CONNECTOR | | | |
|---|---|---|---|---|---|---|---|---|---|---|
| # | PART NO. | TERM. P/N | PIN NO. | COLOR | GUAGE | STYLE | LABELS | PIN NO. | TERM. P/N | PART NO. |
| 48 | MOLEX P/N 43025-0400 | MOLEX P/N 43030-0007 | 1 | GREEN | 20 | 1569 | G | | | MOLEX P/N 19070-0013 |
| | | | 2 | WHITE | 20 | 1569 | R | | | MOLEX P/N 19002-0001 |
| | | | 3 | BLACK | 20 | 1569 | T | | | |
| | | | ~~4~~ | | | | | | | |
| 54 | MOLEX P/N 43025-0400 | MOLEX P/N 43030-0007 | 1 | YELLOW | 20 | 1569 | | 1 | MOLEX P/N 50217-9101 | MOLEX P/N 35156-0200 |
| | | | 2 | BLUE | 20 | 1569 | | 2 | | |
| | | | 3 | ORANGE | 20 | 1569 | | 1 | MOLEX P/N 08-52-0072 | MOLEX P/N 09-50-8023 |
| | | | 4 | PURPLE | 20 | 1569 | | 2 | | |
| 56 | MOLEX P/N 43025-0400 | MOLEX P/N 43030-0007 | 1 | YELLOW | 20 | 1569 | R1 | | | MOLEX P/N 19002-0001 |
| | | | ~~2~~ | | | | | | | |
| | | | 3 | ORANGE | 20 | 1569 | R2 | | | MOLEX P/N 19002-0001 |
| | | | ~~4~~ | | | | | | | |
| 58 | MOLEX P/N 43025-0200 | MOLEX P/N 43030-0007 | 1 | RED | 20 | 1569 | TT | | | MOLEX P/N 19011-0001 |
| | | | 2 | ORANGE | 20 | 1569 | RR | | | |
| 60 | MOLEX P/N 43025-0200 | MOLEX P/N 43030-0007 | 1 | RED | 20 | 1569 | CONNECTOR 'E' IS SHORTED | | | |
| | | | 2 | | | | | | | |

52

FIG. 9

UNIVERSAL CONDENSATE PUMP KIT

CROSS-REFERENCES TO RELATED APPLICATIONS

This is a continuation-in-part application of Ser. No. 10/046,016 filed on Jan. 10, 2002 (abandoned).

BACKGROUND OF THE INVENTION

1. Field of the Invention

The present invention relates generally to condensate pumps for air conditioners or heat pumps and more specifically to a universal condensate pump which simplifies installation of a condensate pump on an air conditioner or heat pump compared with prior art condensate pumps.

2. Discussion of the Prior Art

Installation of a dual voltage condensate pump on an air conditioner or heat pump requires a complicated procedure of cutting various wires, installing connectors and reattaching different wires or connectors to different terminals. Mistakes are easily made by cutting the wrong wire or attaching the wrong connector to the wrong terminal. Hooking a wire to the wrong terminal could result in damage to the condensate pump.

In addition, there are several different brands of air conditioners/heat pumps that use different Original Equipment Manufactured (OEM) type of pumps that are specifically designed for a designated air conditioning/heat pump model. These types of OEM pumps are rated for a nominal voltage of 115 VAC or 208/230 VAC and have specifically designed external wires and connectors for the appropriate air conditioner or heat pump (AC/HP) model.

Accordingly, there is a clearly felt need in the art for a universal condensate pump kit which may be easily installed in different brands of air conditioners and which allows distributors that sell many different brands of AC/HP to inventory only one universal pump model, and several different inexpensive adapting wire harnesses.

SUMMARY OF THE INVENTION

The present invention provides a universal condensate pump kit which does not require a complicated installation procedure or a specifically designed pump for a specific AC/HP model. The universal condensate pump kit includes a universal condensate pump and an adapting wire harness. The universal condensate pump includes a condensate pump, at least one drain switch unit, overflow switch unit, and a condensate tank. Condensate liquid in a heat exchanger drain pan in an AC/HP travels by gravity to the condensate tank. An inlet of the condensate pump draws condensate liquid from the condensate tank and pumps it away from the AC/HP.

The adapting wire harness is used to electrically connect the universal condensate pump with an air conditioner unit or heat pump. Each drain switch unit includes a drain switch, a common terminal, a normally open terminal, and a normally closed terminal, and a drain float unit. If the condensate liquid raises the drain float unit to its maximum height, the drain switch contacts the normally open terminal. The drain switch will close the electrical circuit to the condensate pump, and allow the motor to receive electrical power for the condensate pump operation. The drain switch unit also allows the option to cycle off the AC/HP compressor and will not allow the AC/HP to receive electrical power.

The overflow switch unit includes an overflow switch, a common terminal, a normally open terminal, and a normally closed terminal, and an overflow float unit. If the condensate liquid raises the overflow float unit to its maximum height, the overflow switch contacts the normally open terminal. The overflow switch opens or closes a circuit with the AC/HP that will cycle off the compressor to stop producing the condensate liquid. The circuit will control the operation of the compressor and/or the alarm(s) of the AC/HP. The overflow switch will have all three terminals wired (common, normally open, and normally closed) to ensure that the pump will work with all brands of ACs/HPs. The overflow switch will not allow electrical power to be supplied to the AC/HP. Electrical power will also not be supplied to the condensate pump.

The prior art condensate pump does not have an electrical connection between the drain switch and the overflow drain switch. However, with the universal condensate pump kit, the normally closed terminal of the drain switch unit is either shorted to the common terminal of the overflow switch unit or capable of being shorted with the shorting connector. If the shorting connector is used, a jumper electrically connects the two pins of the shorting connector. However, some condensate pump models do not short the normally closed terminal to the common terminal. The feature of the electrical connection between the drain and overflow switches allows the pump to open the compressor's controlling circuit. In the prior art, the equivalent of the connection feature is accomplished by installing a relay in series with the drain switch.

The universal condensate pump preferably includes at least two connectors. However, two of the at least two connectors could be combined into a single connector. Preferably, one pin of a first connector is electrically connected to the ground of the condensate pump. A second pin of the first connector is electrically connected to the normally open terminal of the drain switch unit. A third pin of the first connector is electrically connected to one end of the motor winding. If a single motor winding is being used then a fourth pin of the first connector is electrically connected to the second rating of the motor.

Preferably, one pin of a second connector is electrically connected to the common terminal of the overflow switch unit. A second pin of the second connector is electrically connected to the normally open terminal of the overflow switch unit. A third pin of the second connector is electrically connected to the normally closed terminal of the overflow switch unit. A fourth pin of the second connector is electrically connected to the common terminal of the drain switch unit.

If the condensate pump has a first and second motor winding, a third connector is used. One pin of the third connector is electrically connected to a normally open terminal of a second drain switch. A common terminal of the second drain switch is electrically connected to the other end of the first motor winding. A second pin of the third connector is electrically connected to one end of the second motor winding and the other end of the second motor winding is connected to the common terminal of the drain switch unit. If the two windings are wired in series, then the condensate pump will be rated for 230 VAC. If the windings are wired in parallel then the pump will be rated for 115 VAC.

If only one motor winding is used, one end of the motor winding will produce a 230 VAC rated motor. If only one motor winding is used, the second drain switch is not needed. The one motor winding may be tapped to produce a 115 VAC rated motor. The other end of the one motor winding is connected to the common terminal of the drain switch. The one end of the motor winding and the tapping wire will be electrically connected to the third and fourth pins of the first connector, as mentioned previously.

The adapting wire harness includes at least two pump connectors, a plurality of device connectors, and a plurality of wires. However, two of the at least two pump connectors may be combined into a single pump connector. The at least two pump connectors terminate one end of the plurality of wires and the plurality of device connectors terminate the other end thereof. A power pump connector from the adapting wire harness mates with the first connector on the condensate pump. At least one logic pump connector on the adapting wire harness mates with the second connector on the condensate pump. When a condensate pump with two windings is used, a third connector will be used. The third pump connector will be used to mate with one of two winding pump connectors on the adapting wire harness. A first winding pump connector on the adapting wire harness places the first and second motor windings in parallel for 115 volt operation. A second winding pump connector on the adapting wire harness shorts the first motor winding to the second motor winding in series for 230 volt operation.

Installation instructions are also included with the universal condensate pump kit for a particular brand and model of AC/HP. The installation instructions describe which of one the connectors should be connected to a particular connector and which device connectors should be connected on the AC/HP.

Accordingly, it is an object of the present invention to provide a universal condensate pump kit which does not require cutting wires on the condensate pump's motor wire leads to install a universal condensate pump.

It is a further object of the present invention to provide a universal condensate pump that is versatile enough to work with all AC/HP brands.

It is yet a further object of the present invention to provide a universal condensate pump which will allow a distributor to reduce their inventory costs by replacing several different types of condensate pumps with one universal condensate pump.

Finally, it is another object of the present invention to provide a universal condensate pump kit which is less complicated to install than that of the prior art.

These and additional objects, advantages, features and benefits of the present invention will become apparent from the following specification.

BRIEF DESCRIPTION OF THE DRAWINGS

FIG. 4 is a wiring table of a universal condensate pump in accordance with the present invention.

FIG. 4*a* is a wiring table of a universal condensate pump with a shorting connector in accordance with the present invention.

FIG. 7 is a wiring table of a universal condensate pump with a single motor winding in accordance with the present invention.

FIG. 7*a* is a wiring table of a universal condensate pump with a shorting connector and a single motor winding in accordance with the present invention.

FIG. 9 is a table of an adapting wire harness in accordance with the present invention.

DETAILED DESCRIPTION OF THE PREFERRED EMBODIMENTS

Figure 2:
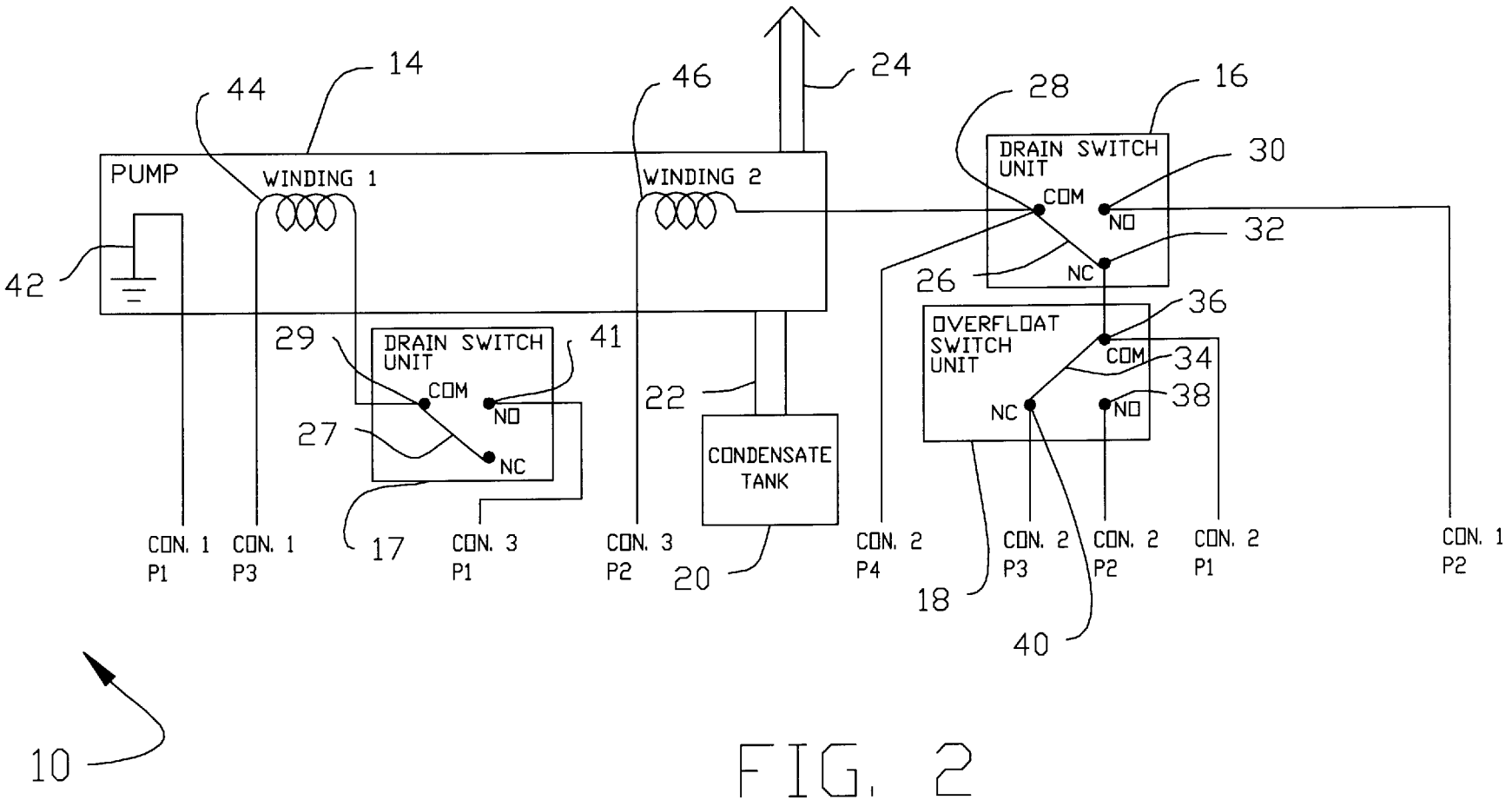
FIG. 2 is a schematic diagram of a universal condensate pump in accordance with the present invention.
Figure 3:
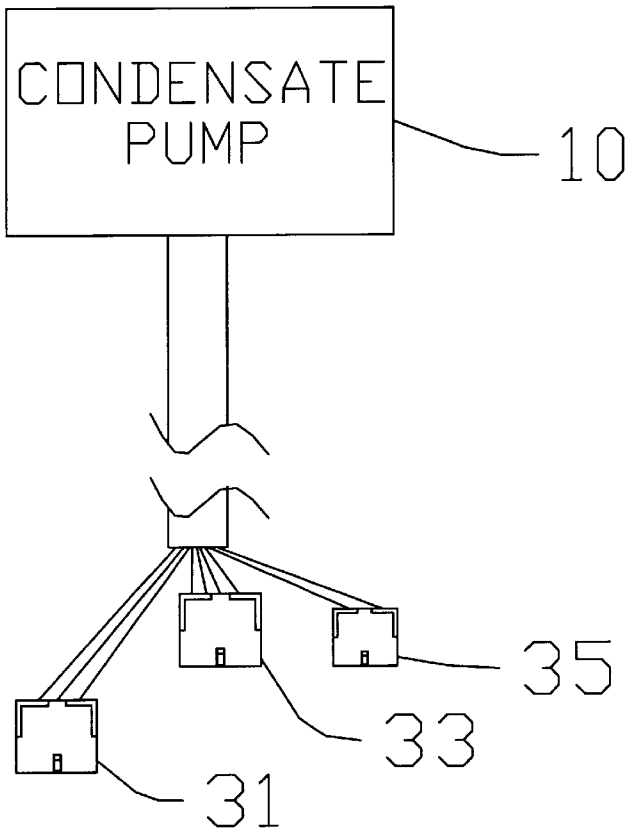
FIG. 3 is a schematic diagram of a universal condensate pump illustrating connectors in accordance with the present invention.
Figure 8:
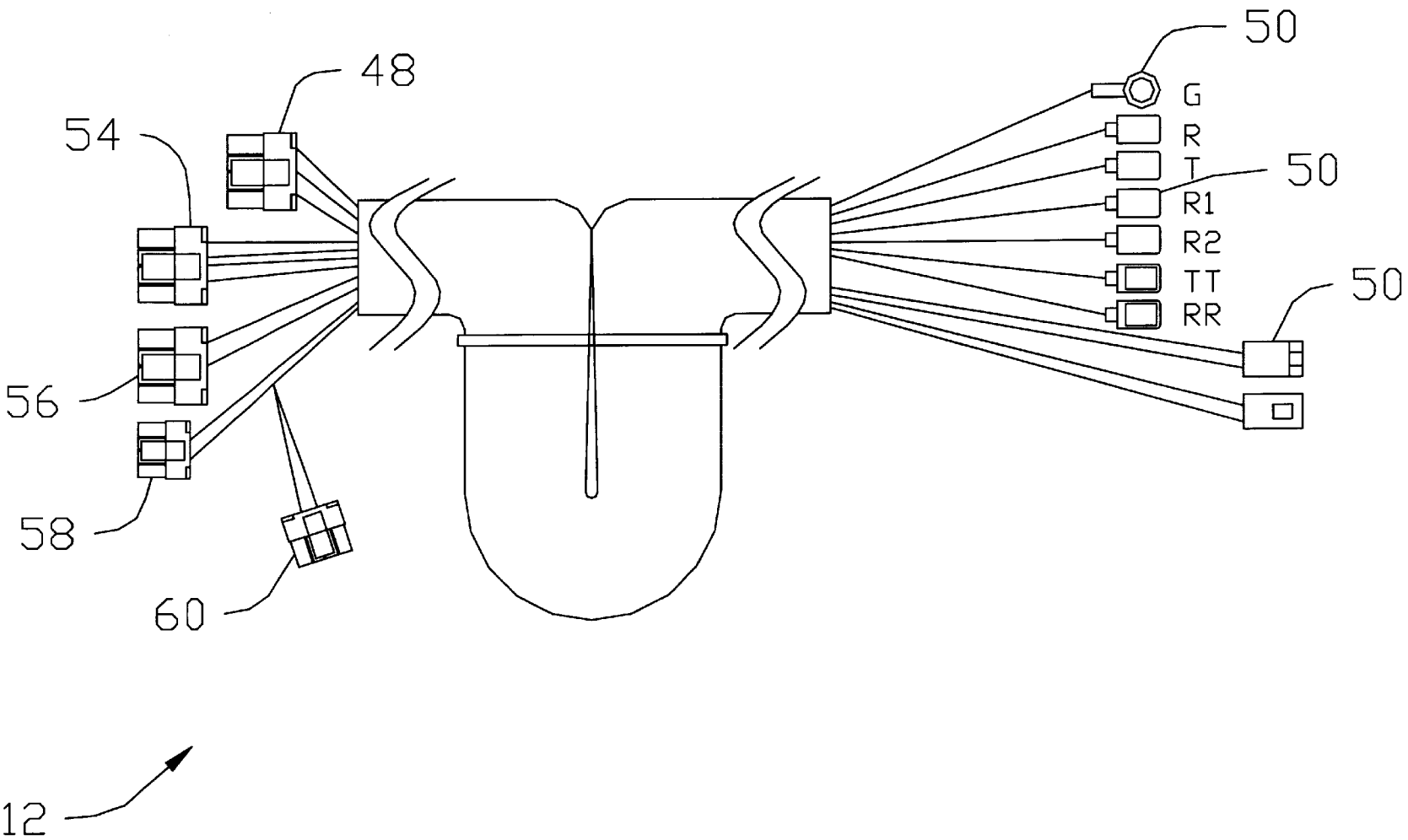
FIG. 8 is a top view of an adapting wire harness in accordance with the present invention.

With reference now to the drawings, and particularly to FIG. 2, there is shown a schematic diagram of a universal condensate pump 10. With reference to FIGS. 3, 4 and 8, the universal condensate pump kit includes a universal condensate pump 10 and an adapting wire harness 12. The universal condensate pump 10 includes a condensate pump 14, a drain switch unit 16, a second drain switch unit 17, an overflow switch unit 18, and a condensate tank 20. Condensate liquid in a heat exchanger drain pan in an AC/HP travels by gravity to the condensate tank 20. An inlet 22 of the condensate pump 14 draws condensate liquid from the condensate tank 20 and pumps it away from the AC/HP through an outlet 24. The condensate pump 14 is electrically connected to the drain switch unit 16, the second drain switch unit 17, and the overflow switch unit 18. The adapting wire harness 12 is used to electrically connect lead wires and connectors from the universal condensate pump 10 with a device such as an air conditioner unit or heat pump.

The drain switch unit 16 includes a drain switch 26, a common terminal 28, a normally open terminal 30, and a normally closed terminal 32, and a drain float unit. Float units which actuate switches to turn on a pump are well known in the art and need not be illustrated. Normally, current flows from the common terminal 28 through the drain switch 26 to the normally closed terminal 32. If the condensate liquid in the condensate tank 20 raises the drain float unit to its maximum height, the drain float unit will cause the drain switch 26 to contact the normally open terminal 30. The drain switch unit 16 will close a circuit that will allow electrical power to operate the universal condensate pump 10, but not allow an AC/HP to receive electrical power. The universal condensate pump 10 allows the option of cycling off the compressor of the AC/HP when the pump is operating by electrically connecting the fourth pin of the second connector 33 with either the second or third pin thereof. The condensate pump 14 will pump the condensate liquid until it falls below a predetermined maximum height of the drain float unit.

The second drain switch unit 17 includes a second drain switch 27, a second common terminal 29, a second normally open terminal 41, a second normally closed terminal 43, and a second drain float unit. The second drain float unit is located in the condensate tank 20. The second drain switch 27 is actuated by the second drain float unit when the level of condensate liquid raises the drain float unit to its maximum height.

The overflow switch unit 18 includes an overflow switch 34, a common terminal 36, a normally open terminal 38, and a normally closed terminal 40, and an overflow float unit. Normally, current flows from the common terminal 36 through the overflow switch 34 to the normally closed terminal 40. If the condensate liquid raises the overflow float unit to its maximum height, the overflow switch 34 contacts the normally open terminal 38. The overflow switch unit 18 will either open or close, depending on how the overflow switch unit 18 is wired to the AC/HP circuit that controls the compressor and alarm(s) of the AC/HP. The overflow switch unit 18 will not allow electrical power to be supplied to an AC/HP. Operation of the condensate pump 14 will not be affected by the operation of the overflow switch unit 18.

Figure 1:
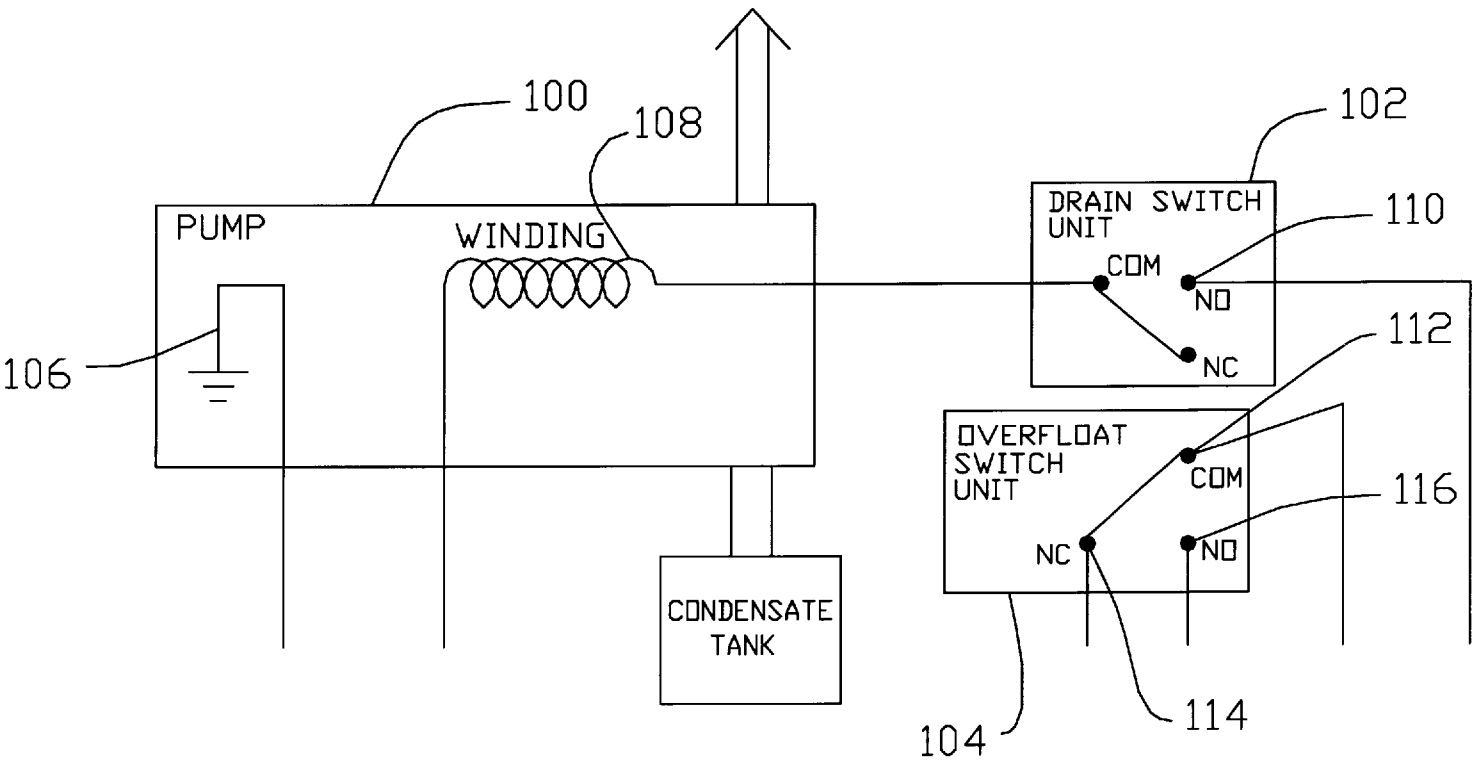
FIG. 1 (PRIOR ART)
FIG. 1 is a schematic diagram of a prior art condensate pump.

Prior art condensate pumps do not have an electrical connection between a drain switch and an overflow drain switch as shown in FIG. 1. However, with the universal condensate pump kit, the normally closed terminal 32 of the drain switch unit 16 is electrically shorted to the common terminal 36 of the overflow switch unit 18. The connection between the drain and over flow switches allows the pump to cycle off the compressor of the AC/HP and/or activate the alarms of the AC/HP when the pump is operating.

Figure 2A:
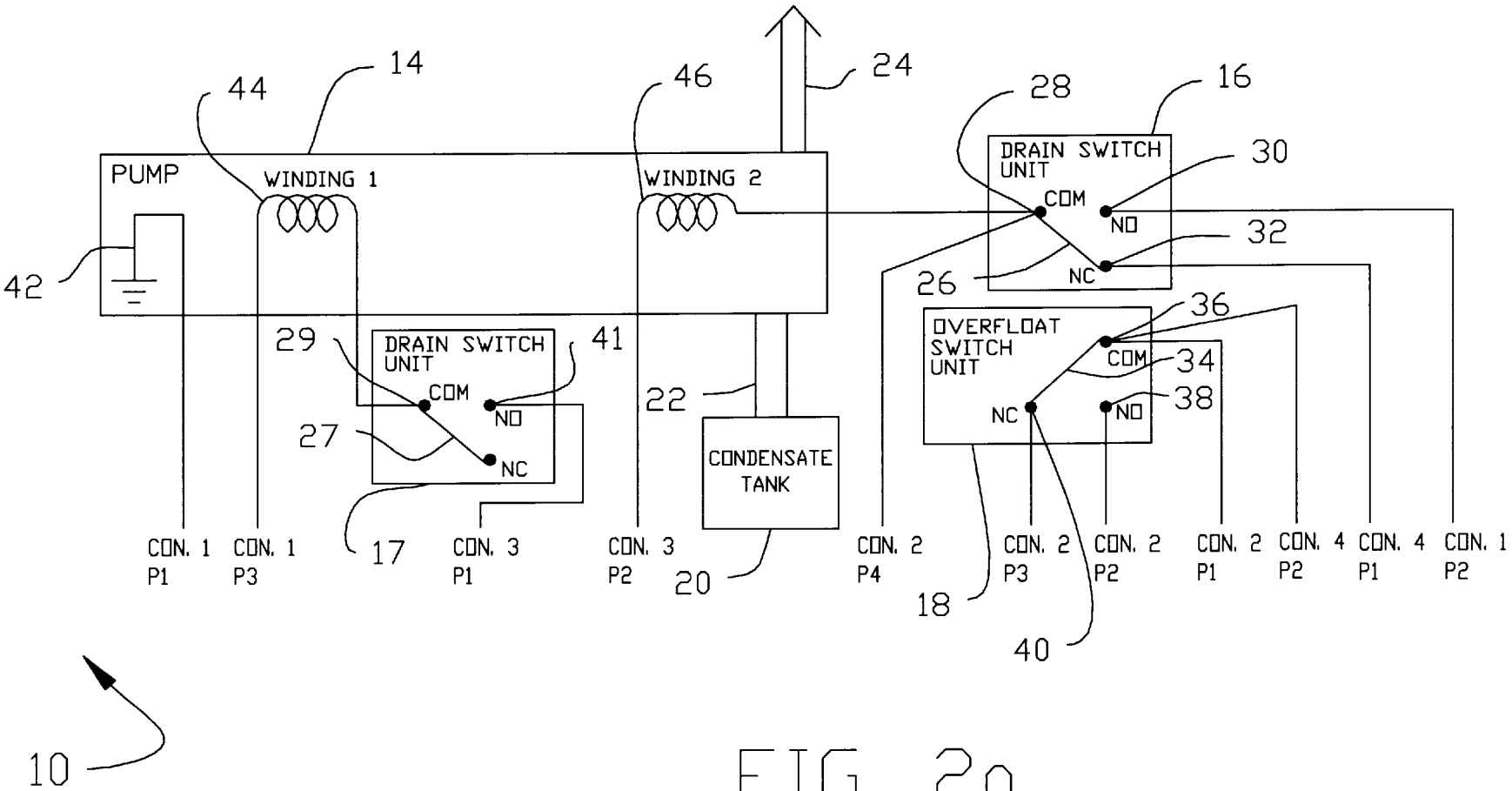
FIG. 2*a* is a schematic diagram of a universal condensate pump with a shorting connector in accordance with the present invention.
Figure 3A:
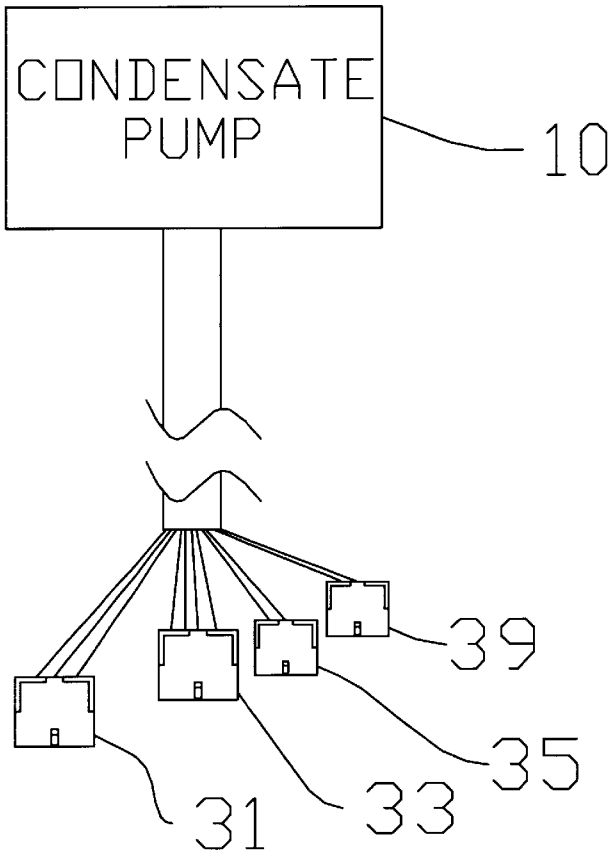
FIG. 3*a* is a schematic diagram of a universal condensate pump with a shorting connector illustrating connectors in accordance with the present invention.

With reference to FIGS. 2*a*, 3*a* and 4*a*, instead shorting the normally closed terminal 32 of the drain switch unit 16 to the common terminal 36 of the overflow switch unit 18, a two pin shorting connector 39 is provided. Some condensate pump models do not short the normally closed terminal 32 to the common terminal 36. If shorting of the normally closed terminal 32 to the common terminal 36 is necessary, the end user may use a jumper cable to electrically short the two pins of the shorting connector 39.

With reference to FIG. 1, external connections of a prior art condensate pump 100, drain switch 102, and overflow switch 104 differ from that of the universal condensate pump 10. Typically, an external connection is made to a ground of the condensate pump 106, a motor winding 108, normally open terminal 110 of the drain switch unit 102, common terminal 112 of the overflow switch unit 104, and normally closed terminal 114 of the overflow switch unit 104. Sometimes an external connection is made to the normally open terminal 116 of the overflow switch unit 104.

In addition to the external connections of the prior art condensate pump 100, the drain switch 102 and the overflow switch 104, the universal condensate pump 10 includes an external connection made to the common terminal 28 of the drain switch unit 16. The external connection to the common terminal 28 allows the pump to cycle off the compressor and/or activate alarm(s) of the AC/HP when the condensate pump 14 is operating. If more than one motor winding is used in the condensate pump 14, more external connections will also be necessary.

The external connections of the universal condensate pump 10 are preferably implemented with at least two connectors. However, two of the at least two connectors could be combined in a single connector. The following connector and pin configurations are given by way of example and not by way of limitation. With reference to FIGS. 3 and 4, one pin of a first connector 31 is electrically connected to the ground 42 of the condensate pump 14. A second pin of the first connector 31 is electrically connected to the normally open terminal 30 of the drain switch unit 16. A third pin of the first connector 31 is electrically connected to one end of at least one motor winding. FIG. 2 shows a first motor winding 44 and a second motor winding 46. However, the first and second motor windings may be replaced with a single motor winding.

One pin of a second connector 33 is electrically connected to the common terminal 36 of the overflow switch unit 18. A second pin of the second connector 33 is electrically connected to the normally open terminal 38 of the overflow switch unit 18. A third pin of the second connector 33 is electrically connected to the normally closed terminal 40 of the overflow switch unit 18. A fourth pin of the second connector 33 is electrically connected to the common terminal 28 of the drain switch unit 16. Providing a pin connection to the common terminal 28 of the drain switch unit 16 and connecting the normally closed terminal 32 of the drain switch unit 16 to the terminal common 36 of the overflow switch unit 18 provides universal application of the universal condensate pump 10 when used with an adapting wire harness.

If the condensate pump 14 has the first motor winding 44 and the second motor winding 46, a third connector 35 is used. One pin of the third connector is electrically connected to the second normally open terminal 41 of the second drain switch 17. The second common terminal 29 of the second drain switch 17 is electrically connected to the other end of the first motor winding 44. A second pin of the third connector 35 is electrically connected to one end of the second motor winding 46 and the other end of the second motor winding 46 is connected to the common terminal 28 of the drain switch unit 16.

Figure 5:
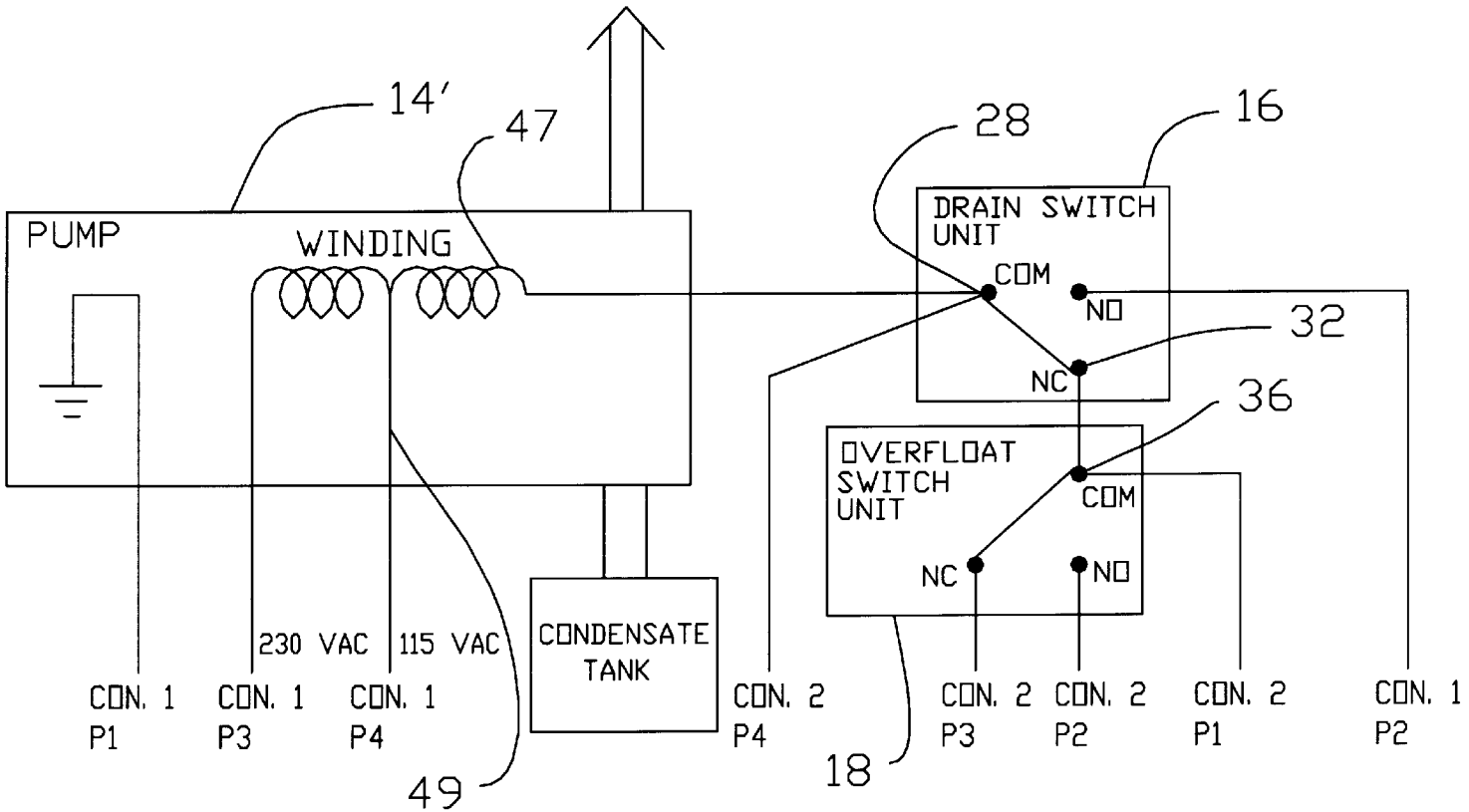
FIG. 5 is a schematic diagram of a universal condensate pump with a single motor winding in accordance with the present invention.
Figure 6:
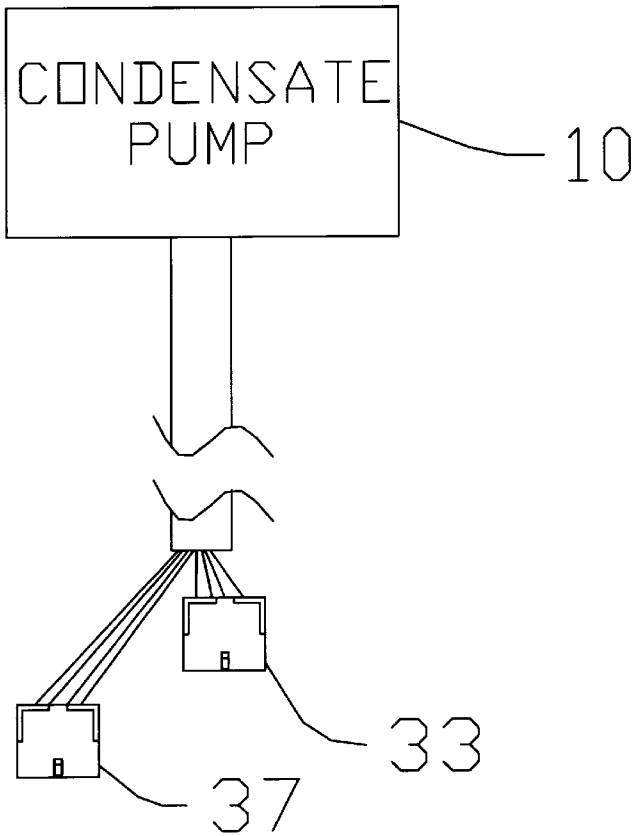
FIG. 6 is a schematic diagram of a universal condensate pump with a single motor winding illustrating connectors in accordance with the present invention.

With reference to FIGS. 5–7, if only one motor winding 47 is used in the condensate pump 14'; one end of the motor winding will produce a 230 VAC rated motor. The one motor winding is tapped to produce a 115 VAC rated motor. The other end of the one motor winding 47 is connected to the common terminal 28 of the drain switch 16. The one end of the motor winding and a tapping wire 49 will be electrically connected to the third and fourth pins of a first connector 37, respectively. The second connector 33 is unchanged from FIG. 3. The second drain switch unit 17 will not be needed with only one motor winding 47.

Figure 5A:
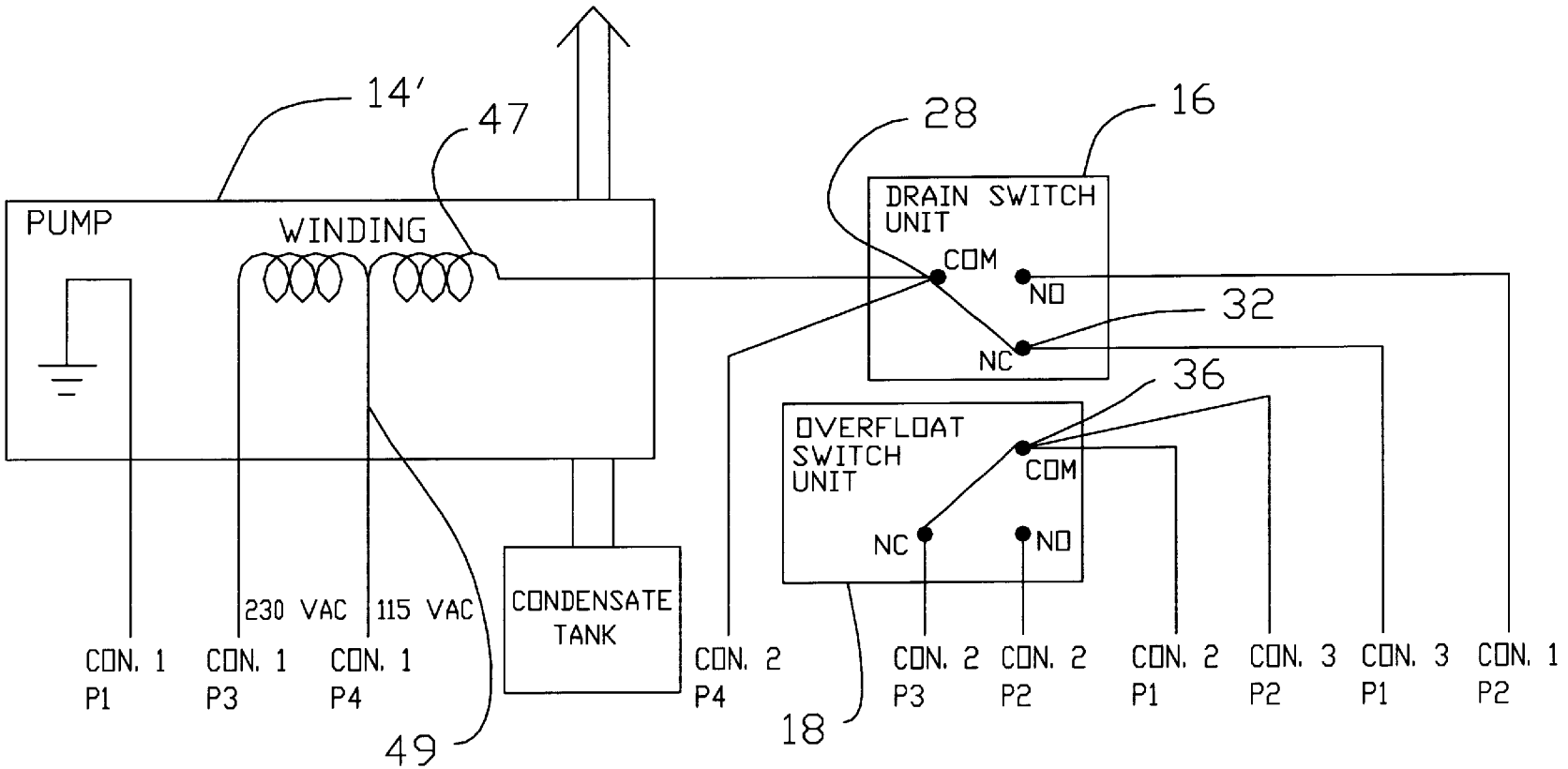
FIG. 5*a* is a schematic diagram of a universal condensate pump with a shorting connector and a single motor winding in accordance with the present invention.
Figure 6A:
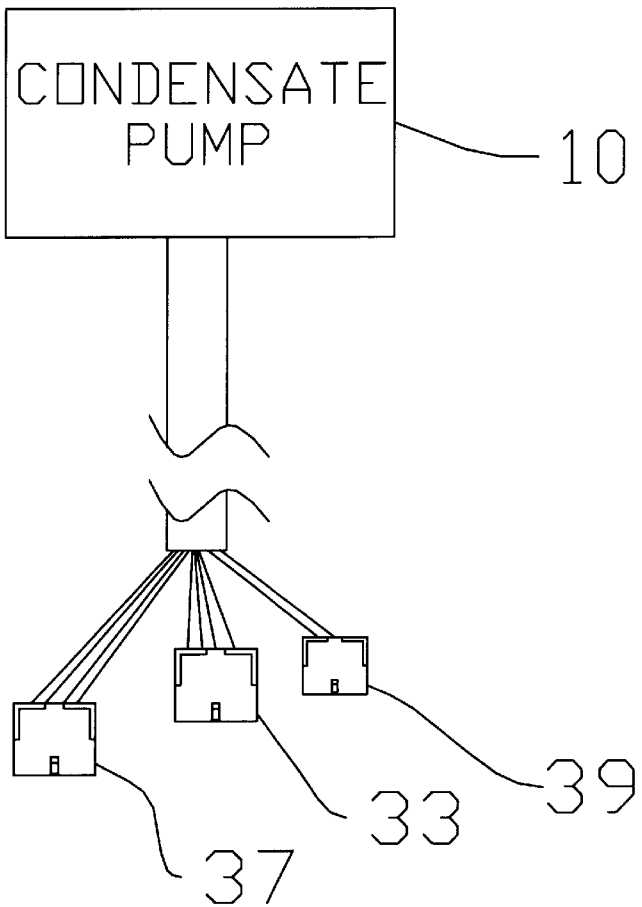
FIG. 6*a* is a schematic diagram of a universal condensate pump with a shorting connector and a single motor winding illustrating connectors in accordance with the present invention.

With reference to FIGS. 5*a*, 6*a* and 7*a*, instead shorting the normally closed terminal 32 of the drain switch unit 16 to the common terminal 36 of the overflow switch unit 18 in FIG. 5, a two pin shorting connector 39 is provided. Some condensate pump models do not short the normally closed terminal 32 to the common terminal 28. If shorting of the normally closed terminal 32 to the common terminal 36 is necessary, the end user may use a jumper cable to electrically short the two pins of the shorting connector 39.

With reference to FIG. 8, the adapting wire harness 12 includes at least two pump connectors, a plurality of device connectors, and a plurality of wires. However, two of the at least two pump connectors may be combined into a single pump connector. The plurality of wires are preferably bundled to form a single structure. The at least two pump connectors terminate one end of the plurality of wires and the plurality of device connectors terminate the other end thereof. A power pump connector 48 mates with the first connector 31, 37. The other end of the wires connected to the power pump connector 48 are terminated with device connectors 50 appropriate for a particular AC/HP. The table 52 shown in FIG. 9 is given by way of example and not by way of limitation. The table 52 includes columns with pump connectors (48, 54, 56, 58, & 60), wire and device connectors 50. The device connectors 50 at the other end of the pins of the power pump connector 48 are labeled G, R, and T.

At least one logic pump connector 54, 56 on the adapting wire harness 12 mates with the second connector 33. FIG. 8 discloses a first logic pump connector 54 and a second logic pump connector 56. Only one of the logic pump connectors can be plugged into the second connector 33. The choice of the first logic pump connector 54 or second logic pump connector 56 depends on the particular AC/HP. The other end of the wires connected to the first and second logic pump connectors are terminated with device connectors 50 appropriate for a particular AC/HP. It may be more economical to have one adapting wire harness with two or more different logic pump connectors to accommodate two or more different brands or models of air conditioners or heat pumps than two different adapting wire harnesses.

If the universal condensate pump 10 has a third connector 35, a first winding pump connector 58 or a second winding pump connector 60 is plugged into the third connector 35. The first winding pump connector 58 places the first and second motor windings in parallel for 115 volt operation. The second winding pump connector 60 shorts the first motor winding to the second motor winding in series for 230 volt operation. The other end of the wires connected to the first and second winding pump connectors 50 are terminated with device connectors appropriate for a particular AC/HP.

Installation instructions are also included with the universal condensate pump kit for a particular brand and model of AC/HP. The installation instructions describe which one of the adapting wire harness pump connectors should be connected to a particular connector of the universal condensate pump 10 and which device connectors should be connected to a mating device connector on the AC/HP.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A universal condensate pump kit for use with a device comprising:

a condensate pump having at least one motor winding, said at least one motor winding having an external connection on one end thereof;

at least one drain switch unit, each one of said at least one drain switch having a drain switch, a common terminal, a normally open terminal, and a normally closed terminal, said common terminal and said normally open terminal each having an external connection, the other end of one of said at least one motor winding being connected to said common terminal;

an overflow switch unit having an overflow switch, a common terminal, a normally open terminal, and a normally closed, said common terminal, said normally open terminal, and said normally closed terminal each having an external connection; and an adapting wire harness having a plurality of wires, one end of said plurality of wires being electrically connected to said external connections and a plurality of device connectors terminating the other end thereof, said plurality of device connectors being matched to a specific device, wherein said at least one motor winding having the capability of being operated with one of two different voltages by choosing one of said plurality of device connectors.

2. The universal condensate pump kit for use with a device of claim 1, further comprising:

said one end of said adapting wire harness being terminated with at least one pump connector.

3. The universal condensate pump kit for use with a device of claim 1, further comprising:

said external connections being retained in at least one connector.

4. The universal condensate pump kit for use with a device of claim 3, further comprising:

said condensate pump having a first motor winding and a second motor winding, said first and second motor windings being capable of being run in series or in parallel, the other end of said first motor winding having an external connection and one end of said second motor winding having an external connection, said external connections being retained in a third connector.

5. The universal condensate pump kit for use with a device of claim 4, further comprising:

said adapting wire harness having a first winding pump connector and a second winding pump connector; and said third connector being attached to a first winding pump connector to run said condensate pump in parallel, said third connector being attached to a second winding pump connector to run said condensate pump in series.

6. The universal condensate pump kit for use with a device of claim 1, further comprising:

said condensate pump pulling condensate liquid from a condensate tank and pumping it away from the specific device.

7. The universal condensate pump kit for use with a device of claim 1, further comprising:

a shorting connector having one pin connected to said normally closed terminal of one of said at least drain switch unit and the other pin connected to said common terminal of said overflow switch unit.

8. A universal condensate pump kit for use with a device comprising:

a condensate pump having at least one motor winding, said at least one motor winding having an external connection on one end thereof;

at least one drain switch unit, each one of said at least one drain switch having a drain switch, a common terminal, a normally open terminal, and a normally closed terminal, said common terminal and said normally open terminal each having an external connection, the other end of one of said at least one motor winding being connected to said common terminal;

an overflow switch unit having an overflow switch, a common terminal, a normally open terminal, and a normally closed, said common terminal, said normally open terminal, and said normally closed terminal each having an external connection; and an adapting wire harness having a plurality of wires, one end of said plurality of wires being electrically connected to said external connections and a plurality of device connectors terminating the other end thereof, wherein said at least one motor winding having the capability of being operated with one of two different voltages by choosing one of said plurality of device connectors.

9. The universal condensate pump kit for use with a device of claim 8, further comprising:

said one end of said adapting wire harness being terminated with at least one pump connector.

10. The universal condensate pump kit for use with a device of claim 8, further comprising:

said external connections being retained in at least one connector.

11. The universal condensate pump kit for use with a device of claim 10, further comprising:

said condensate pump having a first motor winding and a second motor winding, said first and second motor windings being capable of being run in series or in parallel, the other end of said first motor winding being contained in a third connector and one end of said second motor winding being contained in said third connector.

12. The universal condensate pump kit for use with a device of claim 11, further comprising:

said adapting wire harness having a first winding pump connector and a second winding pump connector; and said third connector being attached to a first winding pump connector to run said condensate pump in parallel, said third connector being attached to a second winding pump connector to run said condensate pump in series.

13. The universal condensate pump kit for use with a device of claim 8, further comprising:

said condensate pump pulling condensate liquid from a condensate tank and pumping it away from the device.

14. The universal condensate pump kit for use with a device of claim 8, further comprising:

a shorting connector having one pin connected to said normally closed terminal of one of said at least drain switch unit and the other pin connected to said common terminal of said overflow switch unit.

15. A universal condensate pump for use with a device comprising:

a condensate pump having at least one motor winding, said at least one motor winding having an external connection on one end thereof;

at least one drain switch unit, each one of said at least one drain switch having a drain switch, a common terminal, a normally open terminal, and a normally closed terminal, said common terminal and said normally open terminal each having an external connection, the other end of one of said at least one motor winding being connected to said common terminal;

an overflow switch unit having an overflow switch, a common terminal, a normally open terminal, and a normally closed, said common terminal, said normally open terminal, and said normally closed terminal each having an external connection; and a shorting connector having one pin connected to said normally closed terminal of one of said at least drain switch unit and the other pin connected to said common terminal of said overflow switch unit.

16. The universal condensate pump for use with a device of claim 15, further comprising:

an adapting wire harness having a plurality of wires, one end of said plurality of wires being attached to said external connections and a plurality of device connectors terminating the other end thereof.

17. The universal condensate pump kit for use with a device of claim 16, further comprising:

said one end of said adapting wire harness being terminated with at least one pump connector.

18. The universal condensate pump kit for use with a device of claim 16, further comprising:

said external connections being retained in at least one connector.

19. The universal condensate pump kit for use with a device of claim 18, further comprising:

said condensate pump having a first motor winding and a second motor winding, said first and second motor windings being capable of being run in series or in parallel, the other end of said first motor winding being contained in a third connector and one end of said second motor winding being contained in said third connector.

20. The universal condensate pump kit for use with a device of claim 19, further comprising:

said adapting wire harness having a first winding pump connector and a second winding pump connector; and said third connector being attached to a first winding pump connector to run said condensate pump in parallel, said third connector being attached to a second winding pump connector to run said condensate pump in series.

21. The universal condensate pump kit for use with a device of claim 15, further comprising:

said condensate pump pulling condensate liquid from a condensate tank and pumping it away from the device.

* * * * *